United States Patent [19]

Heath et al.

[11] Patent Number: 4,828,569

[45] Date of Patent: May 9, 1989

[54] DETERGENT COMPOSITIONS FOR REMOVING IODINE STAINS

[75] Inventors: William T. Heath, Briston; William H. Byles, Buena Vista, both of Va.

[73] Assignee: Wen-Don Corporation, Roanoke, Va.

[21] Appl. No.: 172,796

[22] Filed: Mar. 28, 1988

Related U.S. Application Data

[63] Continuation-in-part of Ser. No. 79,144, Jul. 30, 1987, abandoned.

[51] Int. Cl.[4] ..... C11D 1/65; C11D 1/18

[52] U.S. Cl. ..... 8/137; 252/542; 252/543; 252/156; 252/153

[58] Field of Search ..... 252/542, 543, 545, 546, 252/DIG. 14, 153, 174.12, 174.22; 8/137

[56] References Cited

U.S. PATENT DOCUMENTS 3,828,065 12/1975 Savino ..... 134/7

4,407,741 10/1983 Maggi ..... 252/542

*Primary Examiner*—Paul Lieberman

*Assistant Examiner*—John F. McNally

*Attorney, Agent, or Firm*—Nixon & Vanderhye

[57] ABSTRACT

Stains caused by povidone iodine-complex antiseptics are removed from stained linens with detergent formulations containing N-alkyl-2-pyrrolidone, gamma butyrolactone, 2-ethyl-1,3-hexanediol or 4-methyl-1,3-dioxolane-2-one.

20 Claims, No Drawings

DETERGENT COMPOSITIONS FOR REMOVING IODINE STAINS

CROSS-REFERENCE TO RELATED APPLICATIONS

This application is a continuation-in-part of earlier application Ser. No. 079,144 filed July 30, 1987 now abandoned.

This invention provides detergent formulations effective in removing iodine-complex stains from textiles, particularly soiled bed clothing and sheets, and methods for removing these stains.

BACKGROUND OF THE INVENTION

Antiseptics, applied to living tissue to prevent the growth of microorganisms, and disinfectants, applied to inanimate objects for the same purpose, are in widespread use in treating or preventing local infections and in controlling the spread of disease. Of the variety of antimicrobial substances available, iodine and iodophors are perhaps the most widely used in a clinical or medical environment. As a class, the iodophors are a combination or complex of iodine with a solubilizing agent or carrier that liberates free iodine in solution. One of the most commonly used iodophors is a complex of iodine with polyvinylpyrrolidone (1-ethenyl-2-pyrrolididone homopolymer compound), available in numerous forms and known generally as Povidone-Iodine, U.S.P.; see *The Merck Index*, 10th Edition, monograph 7595 (1983). The iodophors are said to produce less pain than do preparations of elemental iodine when applied to wounds and abrasions.

Povidone-iodine commercial products are in pharmaceutical presentations such as aerosol sprays, antiseptic gels, ointments, solutions for mouthwash, gargle or douches, shampoos, scrubs and, notably, surgical scrubs. The prominent U.S. supplier is the Purdue Frederick Company whose products are sold under the Betadine® trademark. Formulations may be bacteriostatic or microbiocidal, killing gram negative and gram positive bacteria, fungi, viruses, protozoa and yeasts.

Hospitals, nursing homes and other health care facilities routinely use povidone-iodine formulations in surgical and other procedures and for patient care. It is inevitable that sheets, gowns, drapes, and other textile products and constructions, described here and known in the trade as linen, when used in medical environments will become soiled with povidone-iodine complex stains. These stains, containing not only iodine, but a polymeric complexing agent, are difficult to remove by the usual laundering techniques and currently available detergent products.

I have devised a way to remove povidone-iodine complex-type stains from textiles soiled with such stains by employing compositions containing as the active ingredient a member selected from the group consisting of an N-alkyl-2-pyrrolidone, gamma butyrolactone, 2-ethyl-1, 3-hexanediol and 4-methyl-1, 3-dioxolane-2-one. N-alkyl-2-pyrrolidone, specifically N-methyl-2-pyrrolidone (as defined in more detail below) is a known compound and has been described in the patent literature as an ingredient with kaolin for removing hardened, baked-on or carbonized food debris from metal cookware (see U.S. Pat. No. 3,928,065); as a paint remover or varnish remover when mixed with blends of alkyl naphthalenes an alkyl benzenes (see U.S. Pat. No. 4,120,810); and in combination with surfactants as a deoxidizer and detergent cleaner to remove oil and grease (see U.S. Pat. No. 4,376,069 and 4,407,741). These prior patents rely upon the organic solvent properties of N-methyl-2-pyrrolidone when formulated for aggressive cleaning, degreasing and even paint-removing uses. To my knowledge, gamma butyrolactone, 2-ethyl-1, 3-hexanediol, 4-methyl-1, 3-dioxolane-2-one, or N-methyl-2-pyrrolidone-containing compositions have not been used in stain-removing environments for textile fibers of the type typically used for fabricating clothing and not for removing stains from garments and other textiles stained by organic bound iodine.

DESCRIPTION OF THE INVENTION

I have developed and hereby disclose detergent formulations and compositions effective in removing povidone-iodine complex stains from linen and cleaning/stain-removing procedures for removing povidone-complex iodine stains from textiles using these compositions and formulations. The formulations of this invention include a combination of nonionic surfactants, anionic surfactants, chelating agents, an anionic hydrotrope, other optional and customary detergent ingredients including colorants, fragrance, diluents and processing aids, and gamma butyrolactone, 2-ethyl-1, 3-hexanediol, 4-methyl-1, 3-dioxolane-2-one, or an N-alkyl-2-pyrrolidone havine the formula:

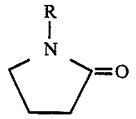

in which R is a lower alkyl group having 1 to 3 carbon atoms; preferably it is N-methyl-2-pyrrolidone available as M-Pyrol® from GAF Corporation, Wayne, New Jersey, USA. The pyrrolidones are miscible with water and many organic solvents. The use of these N-alkyl-2-pyrrolidones or gamma-butyrolactone, 2-ethyl-1, 3-hexanediol or 4-methyl-1, 3-dioxolane-2-one in iodine stain-removing detergent formulations is believed to be unique to the present invention.

Although not wishing to be bound by any particular theory or mode of opertion, it appears that the N-alkyl-2-pyrrolidone or other solvent of the type indicated, when formulated in an appropriate detergent composition, is effective in dispersing or disrupting the polyvinyl pyrrolidone polymer to which the iodine is complexed in the povidone-iodine complex that causes the stain.

The surfactant base formulation in which the solvent is contained is generally composed of a mixture of surfactants, specifically a mixture of anionic and nonionic surfactants, such as disclosed in U.S. Pat. No. 4,105,592 to Collins, the disclosure of which is hereby incorporated by reference. A preferred component is polyoxyethylene (9) nonyl phenyl ether available generally as Nonoxynol 0 and specifically as Tergitol TP-9 from Union Carbide and Igepal CO-630 from GAF Corporation.

A minor amount of a water-soluble organic solvent may be employed. A lower alcohol, usually from 1-5 carbon atoms, is included as a diluent to prepare the liquid compositions. Examples include ethanol, propanol, butanol, isobutanol and pentanol; the preferred alcohol is isopropanol.

Block copolymers such as polyoxyethylene and polyoxypropylene may be included in the formulation, such as Pluronic L61, available from BASF-Wyandotte. The formulation also contains a strong alkali, such as sodium hydroxide or, preferably, potassium hydroxide. An aqueous solution of KOH is convenient for formulating the product. A chelating agent may be included such as the di, tri, and tetrasodium salts of ethylenediamine-tetraacetic acid, and tetrasodium EDTA, available from several commercial sources, is preferred.

A hydrotrope to assist in solublizing the surfactants and other components in the water phase is preferably included in the composition. The hydrotrope is water soluble, has an HLB value about 14, and is technically an aryl alkyl sulfonate having up to 3 carbon atoms in the lower alkyl group. Suitable hydrotropes have a shorter alkyl chain length than the corresponding surfactants typically used in detergent compositions. The sodium and potassium salts of toluene sulfonate, xylene sulfonate, and cumene sulfonate are preferred hydrotropes, sodium xylene sulfonate (the sodium salt of ring sulfonated mixed xylene isomers) is most preferred. The hydrotrope is conveniently added to the formulation in an aqueous solution.

Various other ingredients may be added as desired, including compatible perfumes, coloring materials, optical bleaches, germicides, bleaching agents, and viscosity modifiers.

The pH range of the final formulated solution is within the range of about 12.0 to about 14.0 and is adjusted primarily on the amount of potassium hydroxide included in the composition.

A significant component of the composition, on a percentage weight basis, is water, which represents roughly about half of the weight of the total formulation.

All parts and percentages used herein are reported by weight unless indicated otherwise.

A typical formulation is prepared by premixing the anionic/nonionic surfactant(s), alcohol solvent and block copolymer components. To this premix water is added, with mixing, and the remaining ingredients added with mixing as required preferably after the addition of each component until a homogeneous liquid results.

As stated, one of the objectives of this invention is to contact povidone-iodine stained textiles with a PVP-interrupting or preturbing amount at least one solvent selected from the group consisting of an N-alkyl-2-pyrrolidone, gamma butyrolactone, 2-ethyl-1, 3-hexanediol and 4-methyl-1, 3-dioxolane-2-one and, for best results, to place this ingredient directly on the stain to be removed. Various components in the formulation are subject to wide variation. Expressed on the basis of weight of the N-alkyl-2-pyrrolidone as a percentage of the overall weight of the formulation, the amount of the N-alkyl-2-pyrrolidone or other equivalent solvent of the type defined is in the range of between about 3 to about 15%, preferably from about 3 to about 12%, again depending upon the overall product formulation.

It is convenient to formulate the product with a selection of laundry detergent components to provide the user, often a commercial laundry, with an easy to use yet highly efficient product. The following formulation is but one illustration of stain-removing compositions that form the basis for this invention.

| | parts by weight | parts by weight |
|---|---|---|
| N—alkyl-2-pyrrolidone | 3–12 | 6 |
| surfactants, processing aids | 17–35 | 20 |
| caustic | 2–6 | 3.6 |
| chelating agent | 4–9 | 6.5 |
| solvent, viscosity adjusters | 3–8 | 5 |
| brighteners, dye, perfume, etc. | q.s. | q.s. |
| water | 30–60 | 50 |

A preferred formulation, expressed in percent by weight, is as follows:

| | % by weight |
|---|---|
| surfactant-anionic, nonionic | 13.1 |
| organic solvent (alcohol) | 5.0 |
| Na or K hydroxide (45% aqueous solution) | 8.0 |
| chelating agent | 6.5 |
| optical brightener | 0.2 |
| anionic hydrotrope | 5.0 |
| block copolymer surfactant (40% solution) | 2.0 |
| N—methyl-2-pyrrolidone | 6.0 |
| dye | q.s. |
| fragrance | q.s. |
| water | 54.2 |
| Total | 100 |

EXAMPLE

An iodine stain-removing detergent composition was prepared as follows:

| | | | |
|---|---|---|---|
| 1. | surfactant | Igepal CO-630 | 13.1 |
| 2. | organic solvent | isopropanol | 5.0 |
| 3. | block copolymer | Pluronic L61 | 2.0 |
| 4. | water | — | 54.2 |
| 5. | caustic | KOH (45% solution) | 8.0 |
| 6. | chelating agent | EDTA sodium | 6.5 |
| 7. | anionic hydrotrope | Naxylene sulfonate (40% solution) | 5.0 |
| 8. | N—methyl-2-pyrrolidone | M-Pyrol | 6.0 |
| 9. | optical brightener | Tinopal CBS-X | 0.2 |
| 10. | color | calcomine turquoise | q.s. |

ingredients 1–3 were premixed together in a large vessel and the water added to facilitate mixing. The remaining ingredients were added in the order given, care being taken to mix thoroughly after each addition.

The resulting product was a thin liquid, blue in color, having a characteristic alcohol odor, a pH at 25° C. in the range of 13.0 to 14.0, a specific gravity of 1.057±5%, a viscosity of 7–9 cps (Brookfield Viscometer-LVF, #1 at 60 rpm), and a total solids content of 33.0±2%.

The product may be used as a replacement for the detergent used in laundering operations. In commercial applications, the typical usage rate is 8–16 oz/100 lbs. of laundry when used together with a liquid laundry break, bleach and soft/sour. The stain-removing composition is used in a separate cycle following the break or in the same cycle with the break; bleach and soft-/sour are used in subsequent steps.

The quantity of stain remover is subject to wide variation depending upon the size of the load and the degree of staining in the laundry to be washed. While not essential, hot water is highly preferred for best results, and in any event will be used by commercial laundries. In commercial practice, the stain-removing composition is added to the wash wheel by injection as a predetermined dose via a pump designed to deliver present quantities of the liquid.

What is claimed is:

1. A method of removing povidone-iodine stains from a textile consisting essentially of contacting a povidone-iodine stained textile with a liquid detergent composition composed of a member selected from the group consisting of an N-alkyl-2-pyrrolidone, gamma butyrolactone, 2-ethyl-1, 3-hexanediol, 4-methyl-1, 3-dioxolane-2-one dispersed in an aqueous anionic and nonionic surfactant-containing solution and maintaining the textile in contact with the solution until the povidone-iodine stains have been substantially completely removed from the textile.

2. A method of removing polyvinyl-pyrrolidone-iodine complex stains from a textile comprising contacting the stained textile with an aqueous solution of an amount of a member selected from the group consisting of an N-alkyl-2-pyrrolidone gamma butyrolactone, 2-ethyl-1, 3-hexanediol, 4-methyl-1, 3-dioxolane-2-one sufficient to solubilize substantially all of the polyvinyl-pyrrolidone with which the iodine is complexed and continuing contact, with agitation, until substantially all of the iodine-complex stains are removed.

3. The method of claim 1 or 2 in which the pyrrolidone is a $C_1$-4 alkyl pyrrolidone.

4. The method of claim 3 in which the pyrrolidone is N-methyl-2-pyrrolidone.

5. The method of claim 1 or 2 in which the composition contains gamma butyrolactone.

6. The method of claim 1 or 2 in which the composition contains 2-ethyl-1, 3-hexanediol.

7. The method of claim 1 or 2 in which the composition contains 4-methyl-1, 3-dioxolane-2-one.

8. The method of claim 1 or 2 in which the stained textile is washed in the aqueous solution.

9. The method of claim 8 in which the textile is washed in the aqueous solution at a temperature in the range of about 90° F. to about 200° F.

10. The method of claim 1 or 2 in which the aqueous anionic and nonionic surfactant-containing solution also includes an anionic hydrotrope.

11. A method of removing povidone-iodine stains from a textile comprising washing the textile in an aqueous solution of the composition of claim 1.

12. A method of machine washing soiled textiles stained with povidone-iodine which method comprises the successive steps of:

(1) loading povidone-iodine stained, soiled textiles into a washing machine;

(2) adding a stain-and-soil-removing amount of the composition of claim 1 to the machine as the detergent; and (3) washing the stained, soiled textiles with water at a temperature of about 100° F. to about 160° F., thereby substantially completely removing the povidone-iodine stains.

13. A stain-removing liquid detergent composition for removing povidone-iodine complex stains from a stained textile, consisting essentially, in percent by weight, of:

N-alkyl-2-pyrrolidone, gamma butyrolactone, 2-etyhl-1,3-hexanediol, 4-methyl-1,3-dioxolane-2-one:3–15 anionic and nonionic surfactants:17–35 chelating agent: 4–9 organic solvent: 3–8 water: balance to 100 and an amount of sodium or potassium hydroxide sufficient to provide a pH of from 12.0 to 14.0.

14. The composition of claim 13 also including an optical brightener, perfume or a dye.

15. The composition of claim 13 in which the N-alkyl-2-pyrrolidone is a $C_1$–$C_3$ alkyl.

16. The composition of claim 15 in which the pyrrolidone is N-methyl-2-pyrrolidone.

17. The composition of claim 13 containing from 3–15 percent by weight gamma butyrolactone.

18. The composition of claim 13 containing from 3–15 percent by weight of 2-ethyl-1,3-hexanediol.

19. The composition of claim 13, containing from 3–15 percent by weight of 4-methyl-1, 3-dioxolane-2-one.

20. A povidone-iodine complex stain removing composition for removing such stains from textiles, the composition consisting essentially, in percent by weight, of:

N-alkyl-2-pyrrolidone:3–12 anionic and nonionic surfactants:17–35 chelating agent:4–9 organic solvent, viscosity adjusters:3–8 optical brightener, dye, perfume:0–0.5 water: balance to 100 and sodium or potassium hydroxide to provide a pH in the range of 12.0 to 14.0.

* * * * *